US008544193B2

(12) United States Patent
Grande et al.

(10) Patent No.: US 8,544,193 B2
(45) Date of Patent: Oct. 1, 2013

(54) SNOWSHOE WITH FORWARD FRAME SUPPORT

(75) Inventors: Dodd Grande, Seattle, WA (US); Chris Barchet, Seattle, WA (US); Jay Bublitz, Shoreline, WA (US); Scott Youmans, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 286 days.

(21) Appl. No.: 12/927,414

(22) Filed: Nov. 12, 2010

(65) Prior Publication Data

US 2012/0117827 A1 May 17, 2012

(51) Int. Cl.
*A43B 5/04* (2006.01)

(52) U.S. Cl.
USPC ..... 36/122; 36/123

(58) Field of Classification Search
USPC ..... 36/122, 123, 124, 125
See application file for complete search history.

(56) References Cited

U.S. PATENT DOCUMENTS

| | | | | |
|---|---|---|---|---|
| 3,636,643 | A * | 1/1972 | Lundquist | 36/123 |
| 4,720,927 | A * | 1/1988 | Abegg | 36/122 |
| 5,440,827 | A * | 8/1995 | Klebahn et al. | 36/122 |
| 5,699,630 | A | 12/1997 | Klebahn et al. | |
| 6,006,453 | A * | 12/1999 | Klebahn et al. | 36/123 |
| 6,112,436 | A | 9/2000 | Quellais | |
| 6,226,899 | B1 * | 5/2001 | Klebahn et al. | 36/123 |
| 6,564,478 | B1 * | 5/2003 | Wing et al. | 36/122 |
| 6,725,576 | B2 | 4/2004 | Emerson et al. | |
| 8,020,321 | B2 * | 9/2011 | Matthews et al. | 36/122 |
| 8,171,658 | B2 * | 5/2012 | Samuels et al. | 36/124 |
| 2004/0231200 | A1 | 11/2004 | Forrest et al. | |
| 2008/0141564 | A1 | 6/2008 | Matthews et al. | |
| 2010/0126046 | A1 | 5/2010 | Samuels et al. | |
| 2011/0173844 | A1 | 7/2011 | Samuels et al. | |

FOREIGN PATENT DOCUMENTS

| | | | |
|---|---|---|---|
| FR | 2792540 | A1 | 10/2000 |

* cited by examiner

*Primary Examiner* — Jila M Mohandesi
(74) *Attorney, Agent, or Firm* — Thomas M. Freiburger

(57) ABSTRACT

A snowshoe with binding suspended by tension straps secured to a frame is assembled from a generally U-shaped nose, and an aft section which can be a midsection and a tail. In one embodiment the nose has sufficient strength to resist inward pulling under tension to suspend the binding resiliently, without significant strength contribution from aft portions of the frame. The aft portion of the snowshoe includes traction elements, i.e. rows of teeth, positioned to engage into snow and ice. An important aspect of the invention is that the nose and aft sections are non-integral and very dissimilar in cross section, in a suspended-binding snowshoe.

12 Claims, 18 Drawing Sheets

SNOWSHOE WITH FORWARD FRAME SUPPORT

BACKGROUND OF THE INVENTION

This invention concerns snowshoes, especially snowshoes of the type having a suspended boot binding allowing pivoting in a pitch direction, about a transverse axis.

Modern snowshoes typically consist of a binding to hold the user's foot and boot, a crampon or cleat on the underside of this binding to provide traction on snow and ice directly under the boot, and with the binding being on a rotational axis to allow the crampon and binding to rotate along a transverse (pitch) axis. The snowshoes also sometimes include a suspension system that allows the crampon binding assembly to rotate about a longitudinal (roll) axis, or to translate in the vertical direction, or a combination of both, while limiting rotation about a vertical (yaw) axis.

Attachment of such suspension systems to a snowshoe structure requires certain structural characteristics of the snowshoe to support the suspension. This has typically been achieved by using a tubular aluminum frame that extends around the periphery of the snowshoe, as in snowshoes of Atlas Snowshoe Company.

This tubular aluminum frame, while affording a weight effective way of providing the required structure, also has certain limitations in the traction characteristics it can achieve on certain ice or snow surfaces; the round section of the tubing is rather slippery on certain surfaces.

The current invention seeks to overcome these limitations in traction, by affording the structure required to provide binding and crampon suspension through the use of a tubular aluminum frame nose section that extends around a front portion of the periphery of the snowshoe and is capable of fully supporting the binding suspension. This nose section is combined with other configurations for the aft portions of the snowshoe, so that many variations are possible.

Many patents have described attaching a binding to a snowshoe either by mechanically fixing the binding to the snowshoe frame in a rigid type of attachment or by a suspended type of attachment. In both attachment methods different elements have been used to add traction features to the snowshoe. A suspended binding as described herein means one that is supported from a frame or arms using a flexible element which may be tensioned straps, pulling inwardly on the frame or arms as steps are taken in the snowshoe.

Atlas Snowshoe Company suspends a binding from a snowshoe frame in a way that allows the binding to have limited range of motion in two degrees of freedom along the transverse and longitudinal axes, i.e. in pitch and roll. For example, see Atlas U.S. Pat. Nos. 5,440,827 and 5,699,630. This type of suspension also allows the binding to have a limited range of motion in one degree of translation (up/down) in the vertical direction. The suspension of the binding, that is, the springing resistance of the frame to inward pulling by tensioned suspension straps, is supported by the full length of the snowshoe of the surrounding snowshoe frame members, which is a full-circuit peripheral structure. There are elements added to the snowshoe to provide traction while using the snowshoe to travel on different types of snow conditions. These traction elements are added to the snowshoe deck.

Tubbs Snowshoe Company also has a suspended, tensioned type of snowshoe binding attached to the surrounding snowshoe frame. This binding is also supported by the full length of the snowshoe and surrounding snowshoe frame members. The binding has limited range of motion in two degrees of rotation along the transverse and longitudinal axis. This binding can also have one degree of translation in the vertical direction. Traction elements attached to the snowshoe deck provide traction while using the snowshoe on different snow conditions. These are features of Tubbs Snowshoe Venture model snowshoe.

Tubbs Snowshoe Company has a binding which is rigidly attached to the snowshoe, as shown in U.S. Pub. No. 2010/0126046. In this example there is no peripheral snowshoe frame, but instead a plastic snowshoe deck that supports the binding. The binding can rotate in only one degree of freedom along the transverse axis and no degree of translation in any direction. There are elements formed into the plastic deck for traction and there are elements that are attached to the plastic deck to add traction while traveling on different types of snow conditions. The traction elements are placed toward the middle of the snowshoe and not at the outer edges of the snowshoe. This example does not having a suspended binding.

Mountain Safety Research has a snowshoe with a rigidly attached binding, as shown in U.S. Pub. No. 2004/0231200. The binding is rigidly supported by the surrounding snowshoe frame and has a limited range of motion in one degree of freedom along the pitch or transverse axis. The binding has no degree of translation in any direction. The binding is rigidly attached to a cross brace frame member that is attached to the surrounding snowshoe frame, which is essentially a thin metal rail. The snowshoe in this example does not add elements to provide traction while traveling on different types of snow conditions. Instead this snowshoe uses a type of snowshoe frame members that have bottom traction elements on the frame members. This is not a suspended binding.

Salomon U.S. Pat. No. 6,112,436 describes a snowshoe with a suspended binding. The binding is supported by the surrounding snowshoe deck and has a limited range of motion in two degrees of rotation along the transverse and longitudinal axis, provided by articulating mechanical links. The binding in this example has one degree of translation in the vertical direction. The traction elements in this example are provided on the peripheral bottom surfaces of the snowshoe's deck. The snowshoe does not have frame members of the type discussed above surrounding the binding, but is primarily a composite deck made from plastic materials. The support for the suspended binding is provided by the full length of the snowshoe.

U.S. Pat. No. 6,226,899 of Atlas Snowshoe Company describes a snowshoe assembled from multiple pieces, including molded plastic nose and tail pieces and a pair of rails extending between the nose and tail, forming left and right midsection components of the snowshoe. The snowshoe of that patent has a boot binding/cleat assembly afforded pitch rotation via a transverse pivot shaft. The binding is not suspended.

SUMMARY OF THE INVENTION

This invention includes a nose or front portion of a snowshoe frame used to support a suspended binding of a snowshoe where the binding has two degrees of rotation along the transverse and longitudinal axes and preferably one degree of vertical translation. Supporting the snowshoe's binding with the front portion of the snowshoe frame allows the remainder aft portions of the snowshoe to be constructed in different shapes and materials. The aft portion is connected to and non-integral with the snowshoe's front portion, and the two sections are of dissimilar cross section. An advantage of primarily supporting a snowshoe's binding with the snowshoe's front portion of the frame is that different types of aft sections can be attached to the nose section and can, for example, provide gripping interface between the snowshoe and ground surfaces including snow and ice.

It is an object of the invention to provide a versatile snowshoe design with a nose section that primarily supports a suspended binding, enabling different configurations and materials of aft sections to be secured to the nose section.

These and other objects, advantages and features of the invention will be apparent from the following description of a preferred embodiment, considered along with the accompanying drawings.

DESCRIPTION OF PREFERRED EMBODIMENTS

Figure 1:
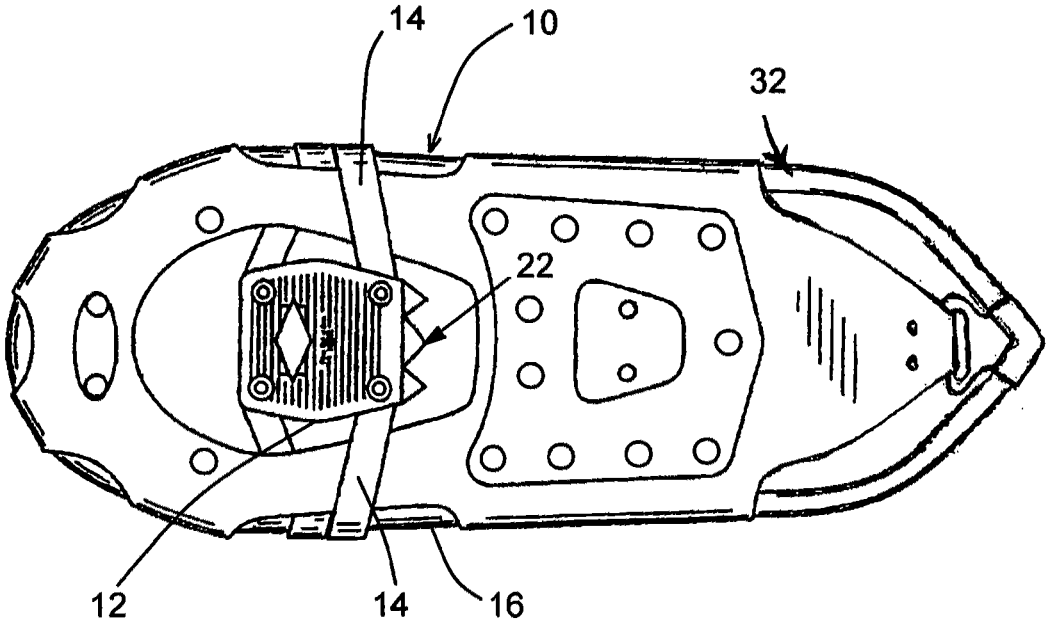
FIG. 1 PRIOR ART
FIG. 1 is a plan view showing an example of a snowshoe with a binding suspended from a peripheral frame, as in prior art.

FIG. 1 shows a prior art snowshoe 10 with a suspended binding 12, with the drawing showing only a footplate and not the binding webbing and straps above, for clarity. This type of suspended binding has typically been used on Atlas Snowshoes (e.g. U.S. Pat. No. 6,725,576), with essentially inelastic straps 14 wrapped around the tubular frame 16 and secured to the cleat/binding platform 12. With the straps wound in this way, this will establish a bias angle on the platform or footbed 12, such that the user's boot tilts heel-upward relative to the snowshoe in the neutral position. This suspension is spring-loaded in that when the platform 12 goes parallel to the snowshoe frame during walking, the frame actually deflects and pulls slightly inwardly, thus urging the platform back to the neutral position. Not only does this suspension provide spring-biased pitch rotation, but also spring-biased vertical up/down translation.

Figure 2:
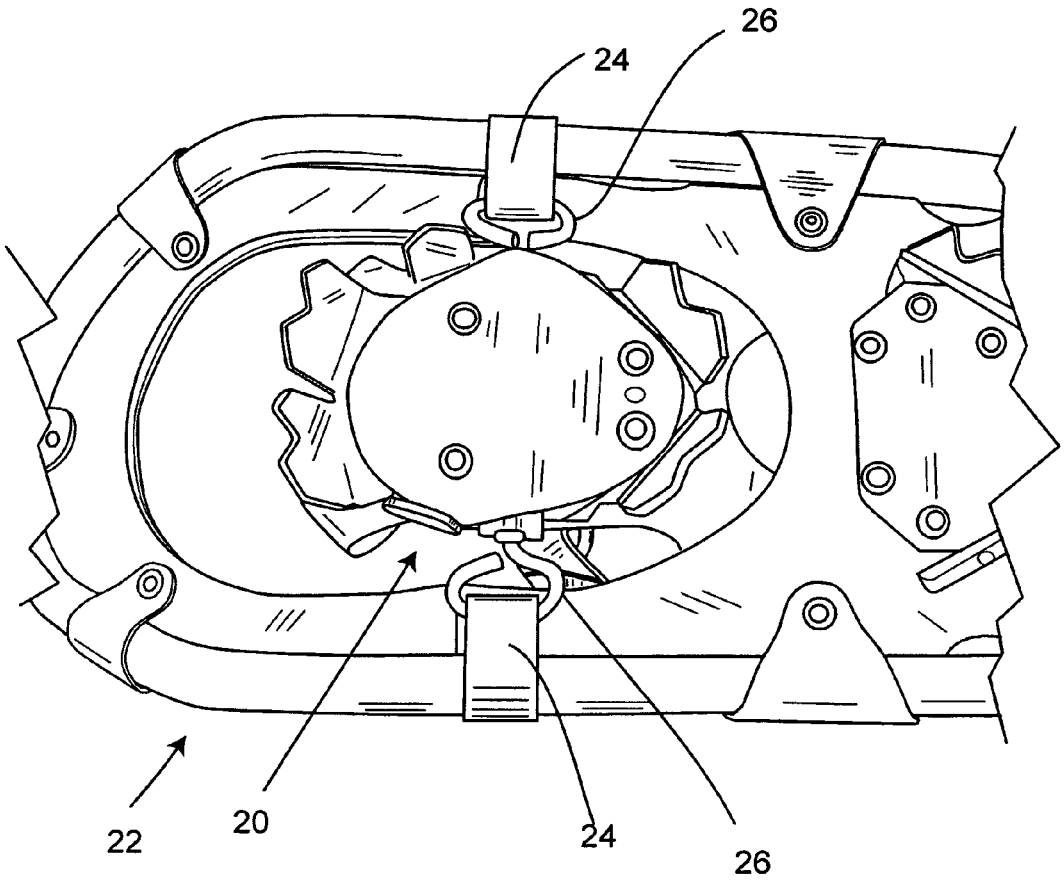
FIG. 2 PRIOR ART
FIG. 2 is a bottom plan view, slightly in perspective, showing another example of a snowshoe with suspended binding according to the prior art.

FIG. 2 shows another type of suspended binding 20 in a snowshoe 22, a Tubbs Venture snowshoe. The binding is suspended with essentially non-elastic bands 24 that retain ends 26 of a center pivot shaft or axle, somewhat hidden in the drawing, allowing free pivoting of the binding relative to the snowshoe in the pitch direction. This suspension allows for some up/down translation.

Figure 3:
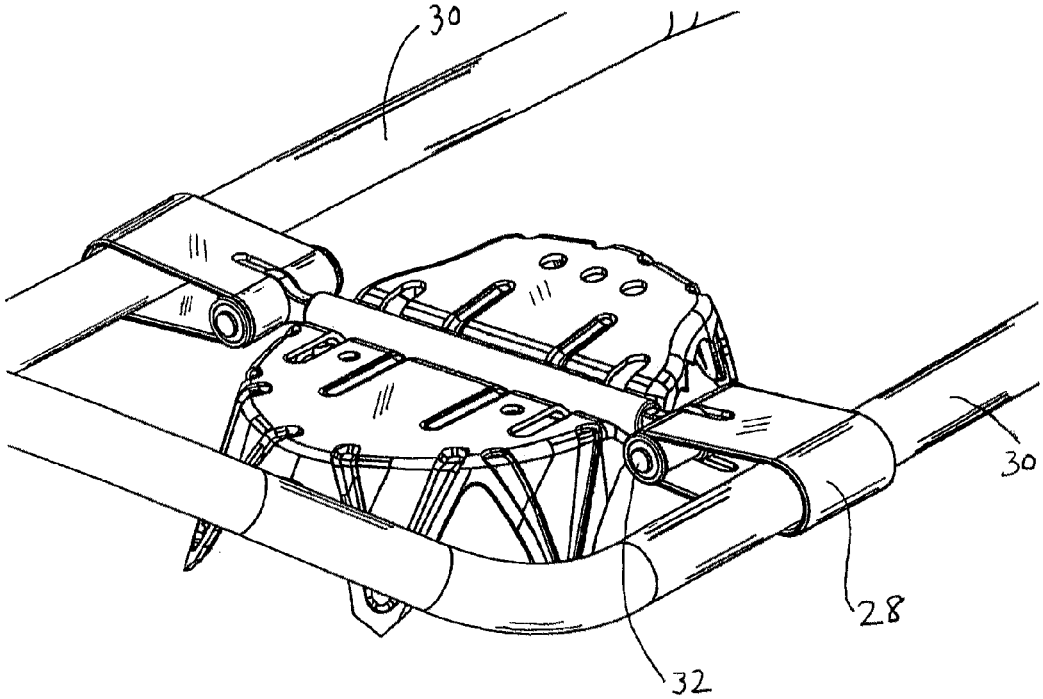
FIG. 3 PRIOR ART
FIG. 3 is a view in perspective, showing a third example of a binding platform suspended from a peripheral frame in a snowshoe.

FIG. 3 shows a further type of prior art binding suspension. The suspended binding platform, shown in U.S. Pub. No. 2008/0141564, a Tubbs Mountaineer snowshoe, allows for vertical translation of the binding in the snowshoe frame, and more particularly it allows for sidehill terrain, permitting the boot and binding to tilt on a roll axis (central longitudinal axis) when sidehill terrain is encountered. Bands 28 extend around a tubular frame 30 to support a roller 32 at each side, allowing for up/down motion of the roller at each side. The rollers are secured to a pitch pivot shaft for free pitch rotation. FIG. 3 does not show the binding itself.

All of the above binding suspension systems, FIGS. 1-3, utilize the full length of the snowshoe frame for suspension, the frame elastically deforming as a spring as steps are taken and tension is increased in the suspension elements.

Figure 4:
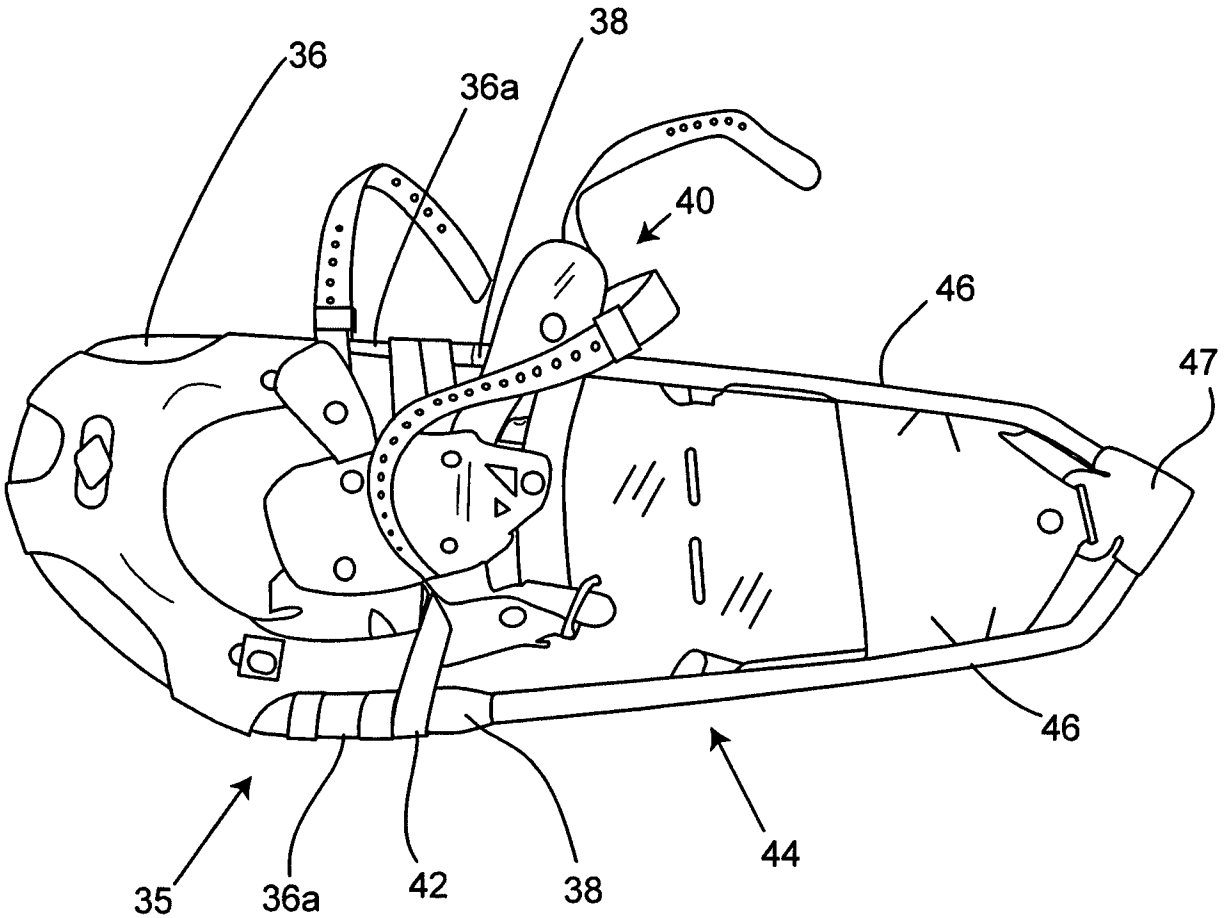
FIG. 4 is a perspective view showing the upper side a snowshoe according to the invention, with a frame nose section which provides support for a suspended binding of the snowshoe.

FIG. 4 shows a snowshoe of the invention, in a first embodiment. The snowshoe 35 has a generally U-shaped nose section 36 having an upturned forward end as is typical and extending back to rear ends 38 of the nose section. The binding 40 is suspended on the nose section by straps 42 wound around the nose section near the aft ends 38, providing a binding suspension such as typically used on Atlas snowshoes and illustrated as suspended by the whole frame in FIG. 1. The snowshoe has an aft portion 44 that can be tubular but preferably is another configuration, having traction teeth or crampons at the bottom side of the rails 46 that form a frame for this aft portion. The binding suspension is supported essentially entirely by the two arms 36*a* of the nose section, via the straps 42. Even though the connection to the aft portion of the snowshoe 44 may contribute some resistance to inward pulling of the nose section's arms, in a preferred form of nose section this section alone has sufficient strength and resilience to fully suspend the binding, for a person weighing up to about two hundred pounds or more.

For adult snowshoes, for persons in a weight range of about eighty to three hundred pounds plus clothing and gear, the lateral inward pulling force the frame must support (in the present case, the nose section must support) is approximately in the range of thirty pounds to one hundred eighty pounds or somewhat higher. As one example within this range, a person weighing about two hundred pounds, on a binding suspended in the manner illustrated in FIG. 1 or FIG. 4, typically will exert an inward pulling force of about one hundred eight pounds. These lateral forces must be supported by the nose section of the invention, without failure of the nose section. At the same time, the nose section cannot be rigid but must be resilient to provide the springing support needed for the suspension. A spring constant for the nose section can be in the range of about 100 to 200 per inch or more, preferably at least about 120 pounds per inch. A spring constant of the assembled snowshoe can in many cases be considerably higher, depending on the aft section configuration. At a minimum, the arms of the nose section of the invention must support at least thirty pounds of pulling force from the binding without failure, and with resilience, and preferably at least about 50 pounds. As a comparison, a test conducted on a snowshoe of a type discussed above, comprising a metal frame essentially formed of flat metal crampon rails with cross sections oriented vertically, showed those rails could support an inward lateral compressive force of only about eight pounds, after which the sides of the frame bent and deformed inwardly until they met at the middle.

Figure 5:
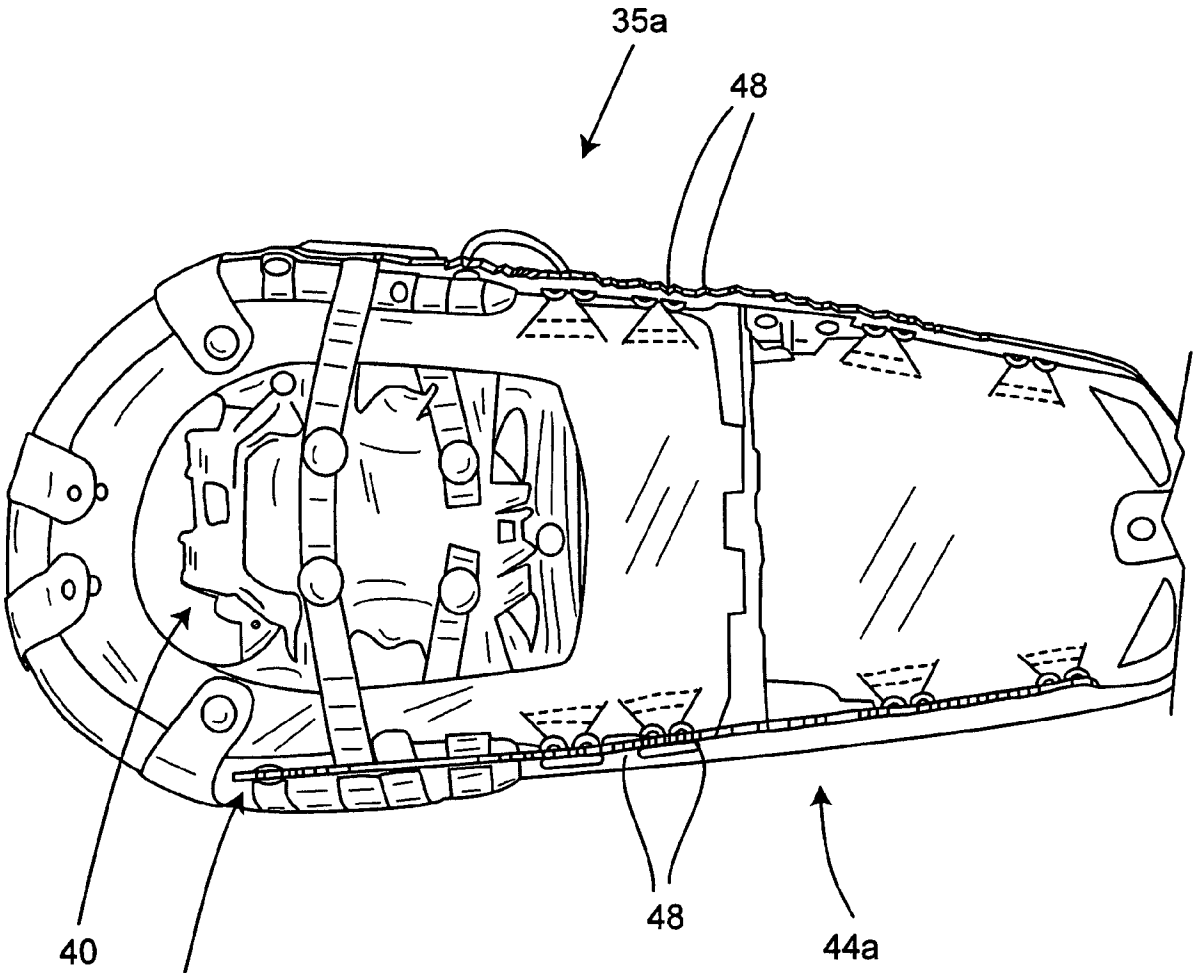
FIG. 5 is a bottom perspective view showing a snowshoe according to the invention, with nose sections supporting the suspended binding.
Figure 6:
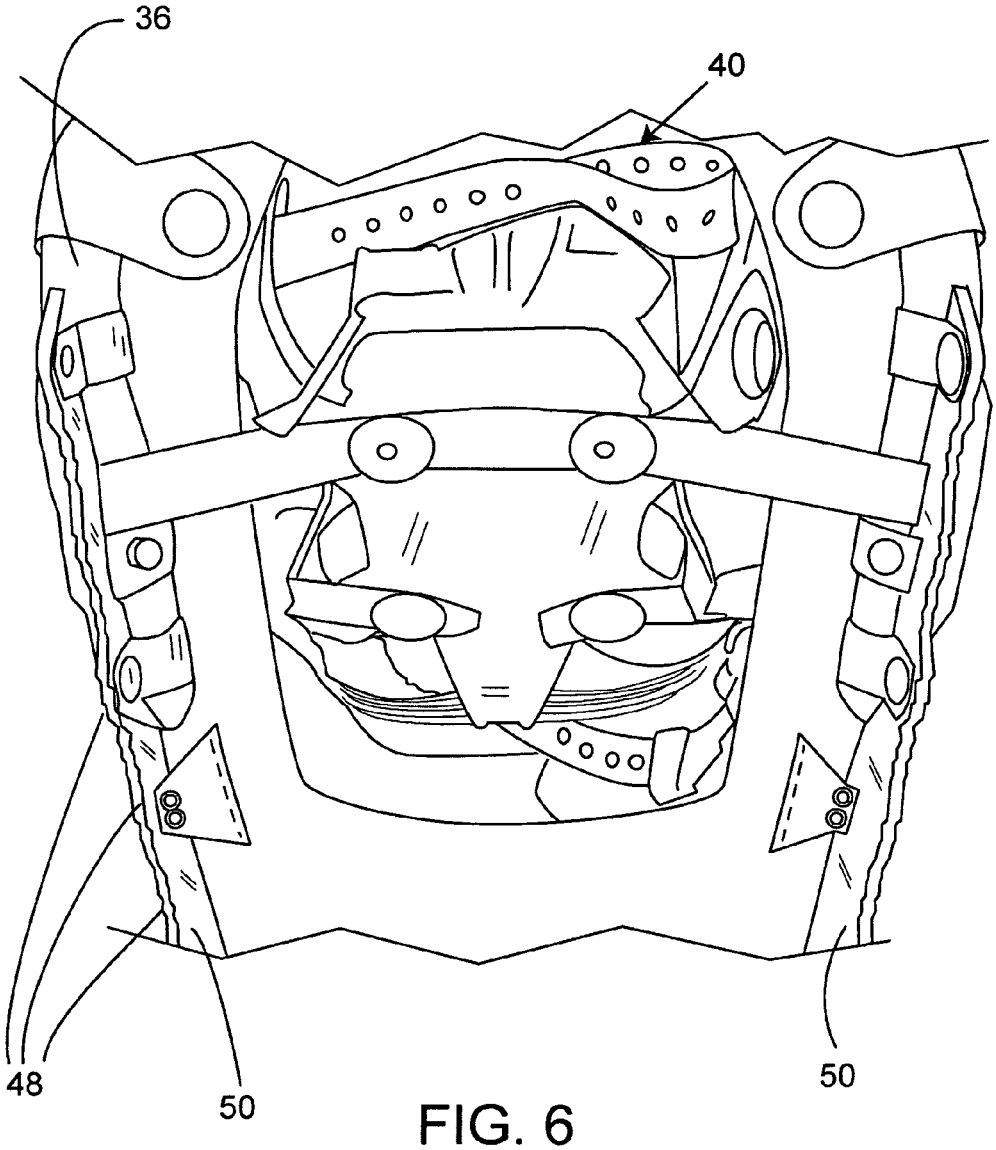
FIG. 6 is another bottom perspective view showing the snowshoe of FIG. 5.

FIG. 5 is a bottom view of a snowshoe 35*a* of the invention, with a nose section 36 as in FIG. 4 and as discussed above. The binding 40 is suspended in the same manner as in FIG. 4, and support is provided essentially entirely by the nose section 36. Crampon teeth 48 are positioned along the bottom of the snowshoe, all through the aft portion 44*a* and preferably overlapping with rear portions of the nose section. FIG. 6, a bottom view from a different angle, better illustrates these crampon rails 50 and teeth 48.

Figure 7:
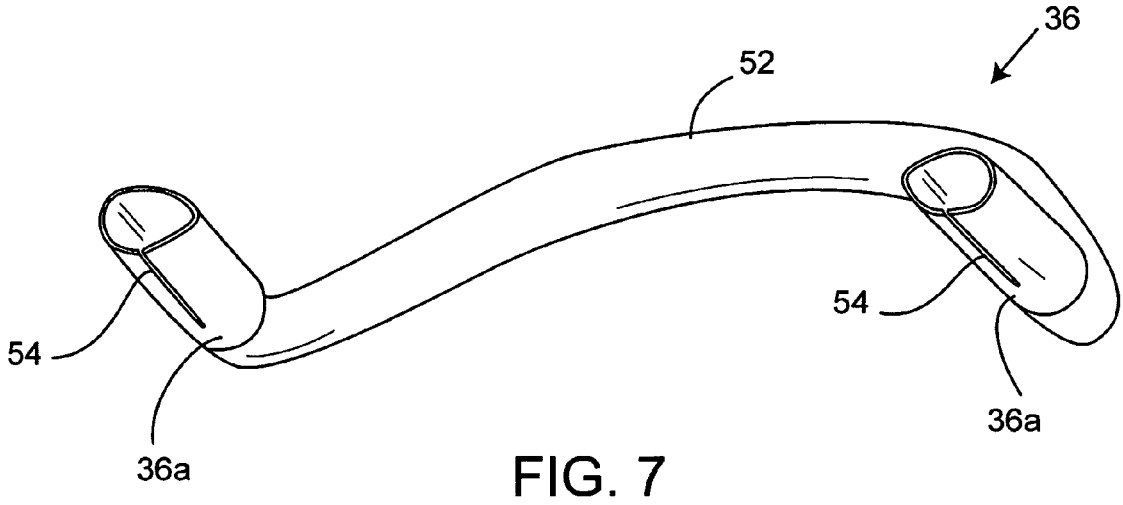
FIG. 7 is a perspective view showing a front or nose section of a snowshoe according to the invention, for assembly to aft components of the snowshoe.

FIG. 7 shows a configuration of a nose section 36 of the invention. The nose has a rounded, upwardly turned forward end 52, and is generally horseshoe-shaped, with rear extending arms 36*a*. Each of the arms has a slit 54, for the purpose of the assembly shown in FIG. 6 and the components indicated in FIGS. 7, 8 and 9. The nose section may be formed of aluminum tubing, preferably aluminum 6061 T6 (although other aluminum can be used), and with the strength and resilience characteristics in the shaped nose piece as explained above. The tubing can be about 19 mm O.D. with a wall thickness of about 0.75 to 1.5 mm.

Figure 8:
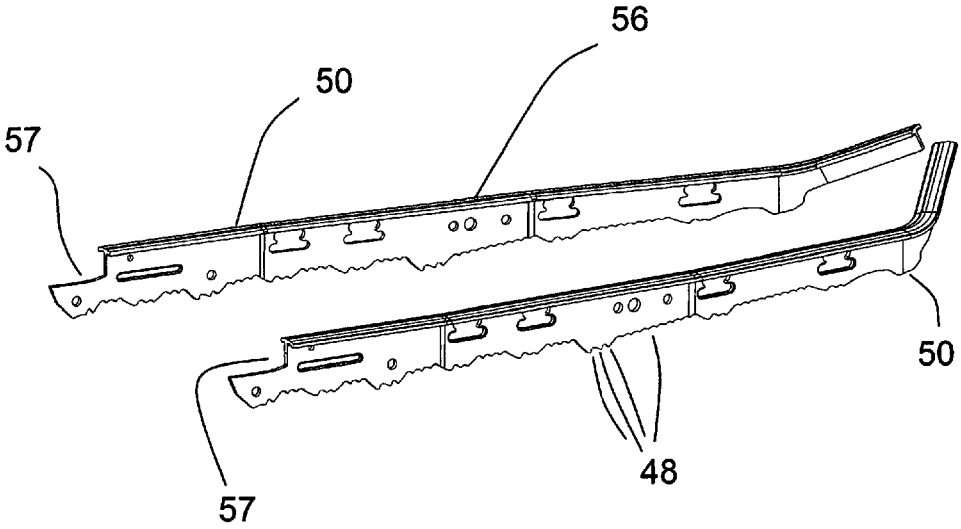
FIG. 8 is a perspective view showing a pair of traction rails that serve as part of an aft frame when connected to the nose section shown in FIG. 7.
Figure 9:
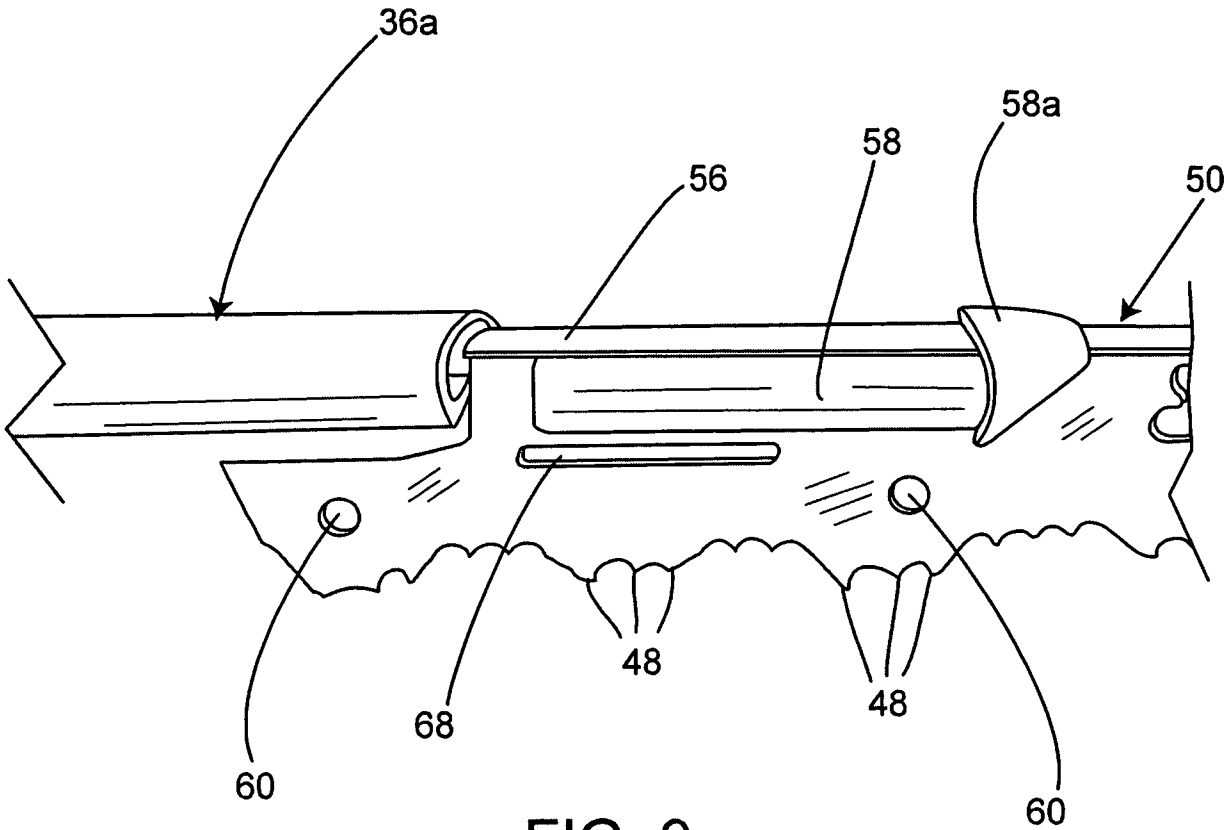
FIG. 9 is an elevation view indicating assembly of the nose section of FIG. 7 to a traction rail component as in FIG. 8.

FIG. 8 shows the rails 50 to be assembled to the nose section 36 of FIG. 7. The rails are positioned essentially as they would be in the assembled snowshoe. A tail end piece, of a type generally as shown at 47 in FIG. 4, is used to secure the two rails together at the tail. As seen in FIGS. 8 and 9, the crampon rails 50 are preferably formed with a flat or slightly rounded top surface 56 which can be generally in a T configuration with the downwardly extending vertical rail, and a notch 57 is present at the forward ends of the rails, where the lower section with teeth continues forward for a distance but the above structure does not.

Figure 10:
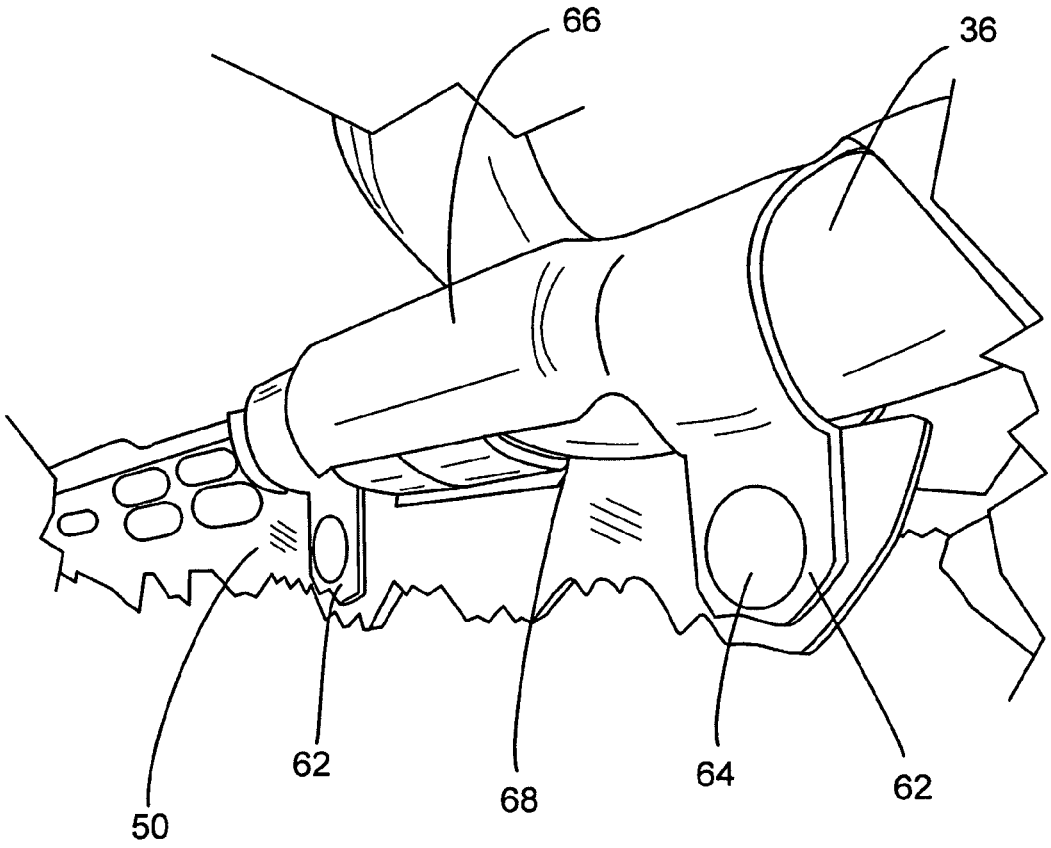
FIG. 10 is a perspective side view showing the components of FIGS. 7 and 8 assembled and secured together.
Figure 11:
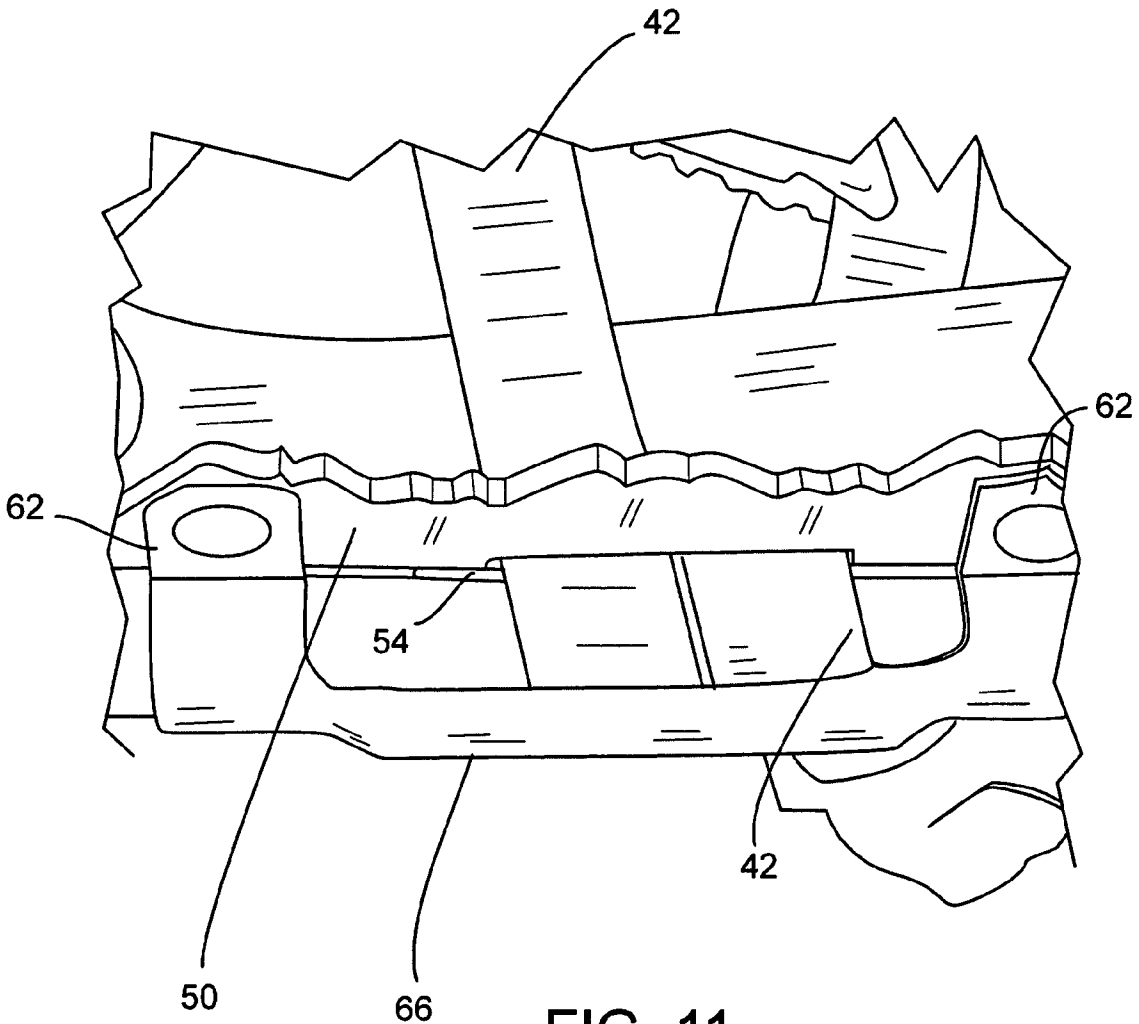
FIG. 11 is a bottom perspective view showing the assembly.
Figure 12:
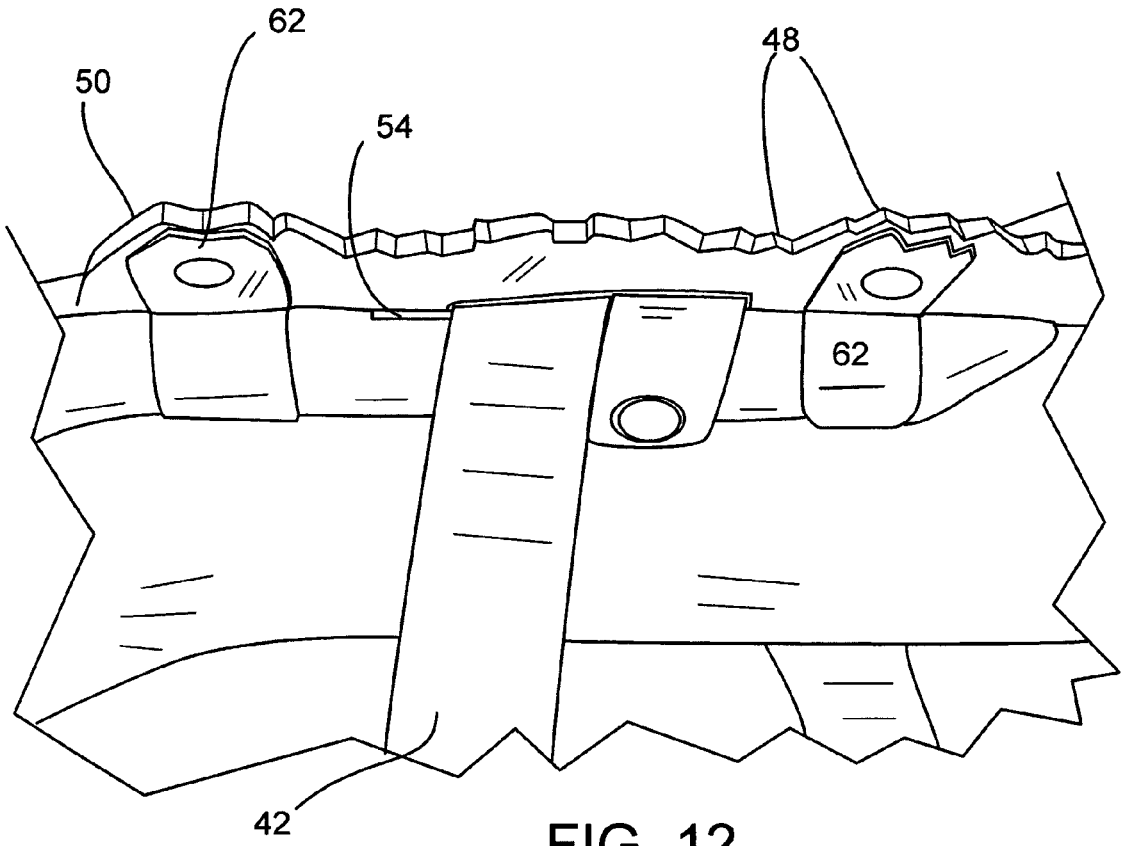
FIG. 12 is another bottom perspective view showing the assembly.

FIG. 9 indicates the nose piece arm 36*a* in position to be assembled to the rail 50. The nose piece arm 36*a* has a slit in its bottom side as shown in FIG. 7, so that the arm can slide over the top portion of the rail 70 for assembly. A plastic filler 58 is provided, slidably positioned on the rail 50 and extending over both sides of the rail, to provide a close and stable fit between the rail and the nose section, essentially filling the inner volume of the arm 36*a*. With the filler piece 58 correctly positioned, the assembly is made by sliding the nose piece and rail together such that the upper surface 56 of the rail is engaged against the inside of the nose piece arm 36*a* and the filler 58 is captured within the tubing. An end cap 58*a* of the filler engages against the end of the tube 36*a*. Connector brackets are then secured over the nose piece and to the rail via holes 60 provided for this purpose (holes shown in FIG. 9), as seen in FIG. 10. The brackets are shown at 62, each girdling the tubing of the nose section and engaging against the rail 50 at both sides. A fastener (bolt or rivet) 64 secures these brackets. As indicated in FIGS. 10 and 11, the brackets 62 can be integral with a shield 66 that extends over and protects the edges of the strap 42 at each side. The strap passes through the rail, into two passes as shown in FIGS. 10-12, via an elongated slot 68 most clearly visible in FIG. 9.

It is seen that the connection of the two rails 50 to the nose section 36 adds only minimally to the stiffness of the nose section itself, toward resisting the inward pulling from the binding suspension. Different aft sections and different forms of connection have different effects on strength and stiffness. In one embodiment the nose section preferably is of sufficient strength to fully support the suspension without any contribution from aft portions of the snowshoe. In other embodiments the nose section can be of lesser strength, relying on some contribution from the aft section.

Figure 13:
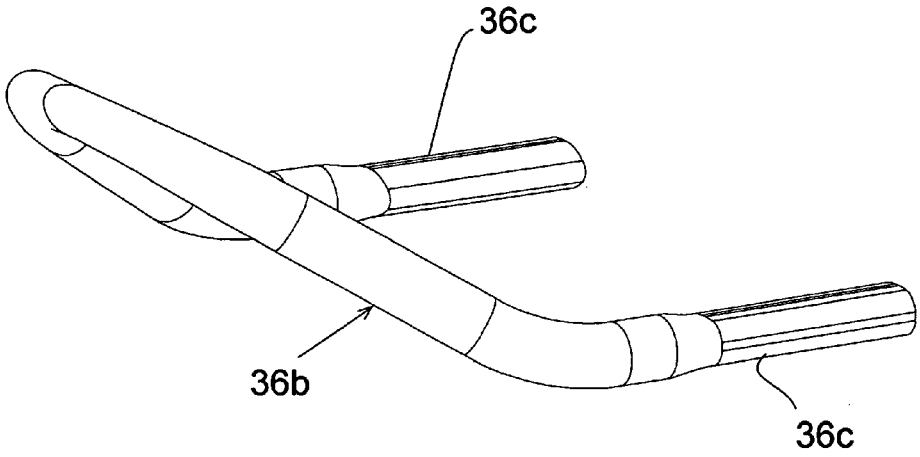
FIG. 13 is a perspective view showing another form of nose section according to the invention.

FIG. 13 shows another nose section 36*b* which can form a part of the invention. In this nose section the arms 36*c* extending rearwardly can be reduced diameter, to receive tubing sections as aft portions of the snowshoe, or as a mid-section, if a separately fabricated tail is included. The tubing frame members (not shown) are assembled by sliding over the arms 36*c*, then secured by bolts or riveting.

Figure 14:
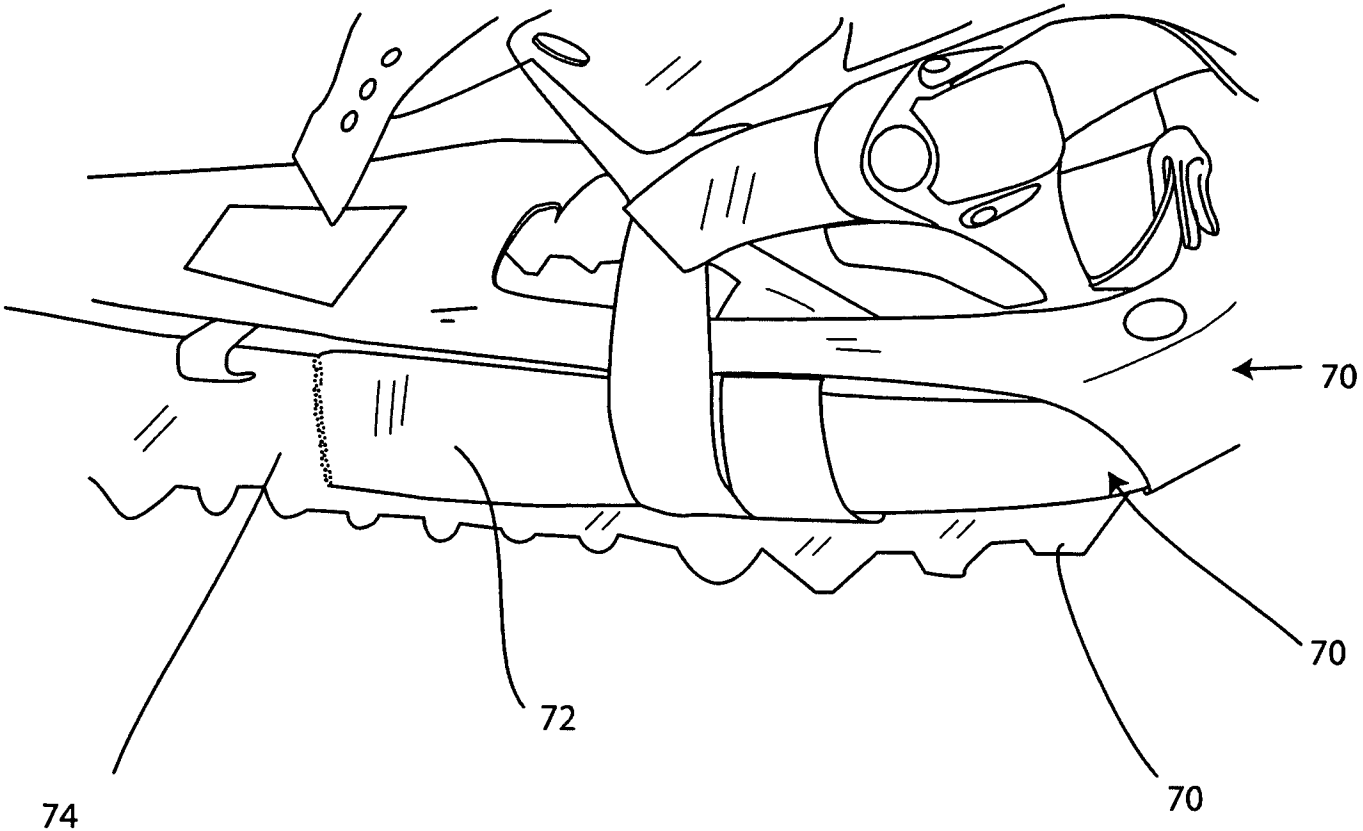
FIGS. 14 and 15 are side perspective and bottom views showing another snowshoe with a different form of nose section.
Figure 15:
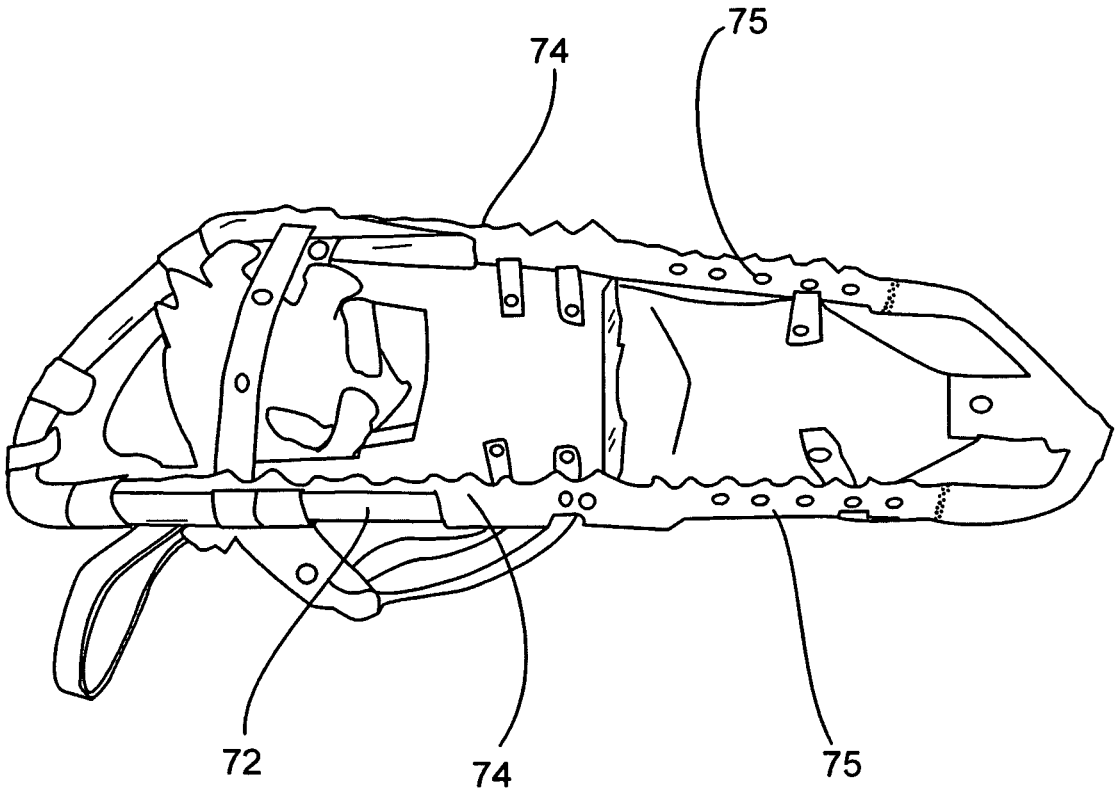
Figure 16:
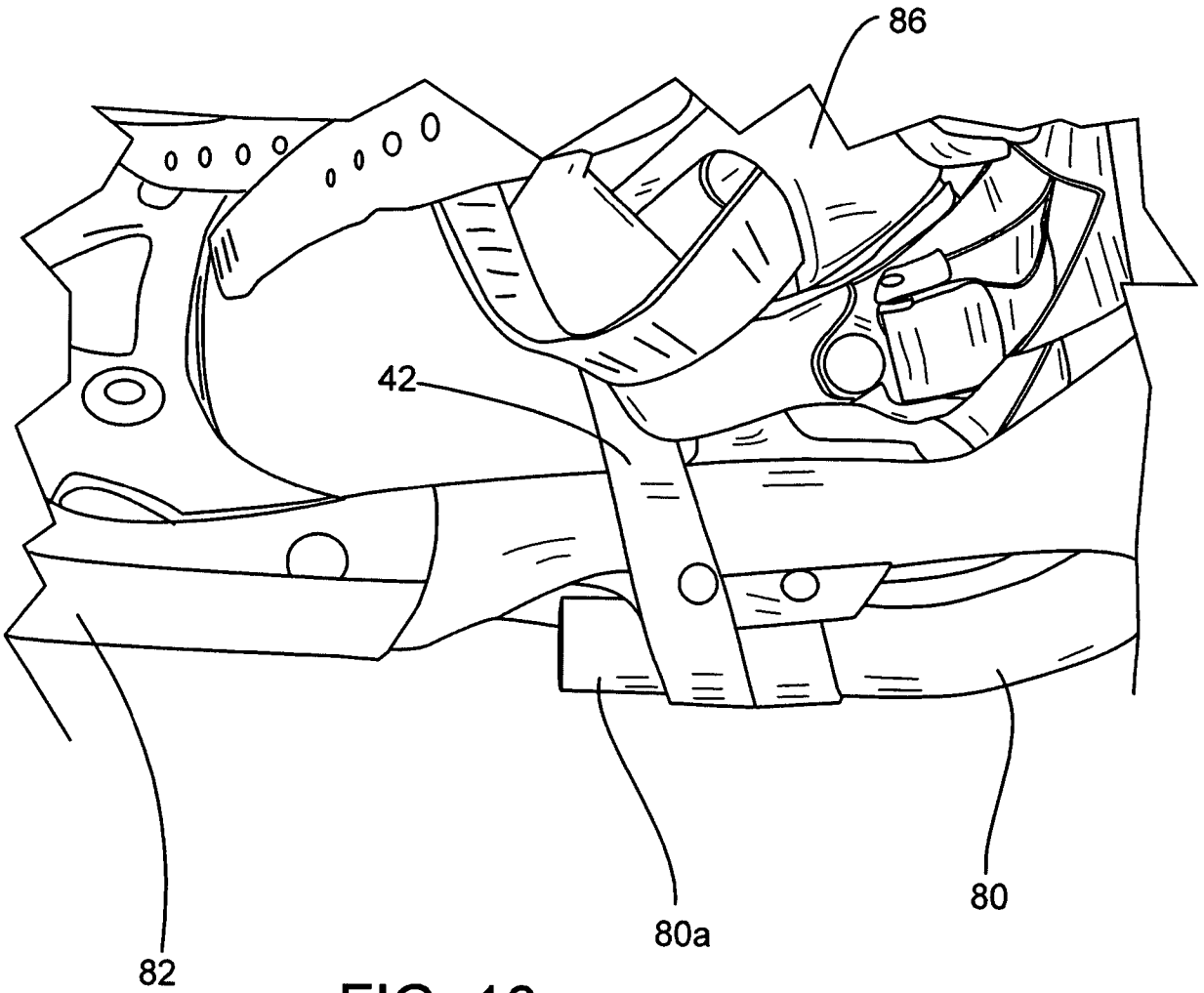
FIGS. 16, 17 and 18 are upper perspective and bottom perspective views showing another snowshoe embodiment.

FIGS. 14 and 15 show another form of connection between a nose section 70 and crampon rails 74 serving as an aft section. In this case the nose section 70, which can be tubing as shown (slit and essentially flattened in an aft region at 72) is welded to a crampon rail 74, extending into the slit, as shown. This provides flat rear rail arm extensions 74 of the nose piece that can be secured together with aft rail sections 75 by overlapping and bolting or riveting, as shown in FIG. 16. Other types of aft sections could be used if desired.

Figure 17:
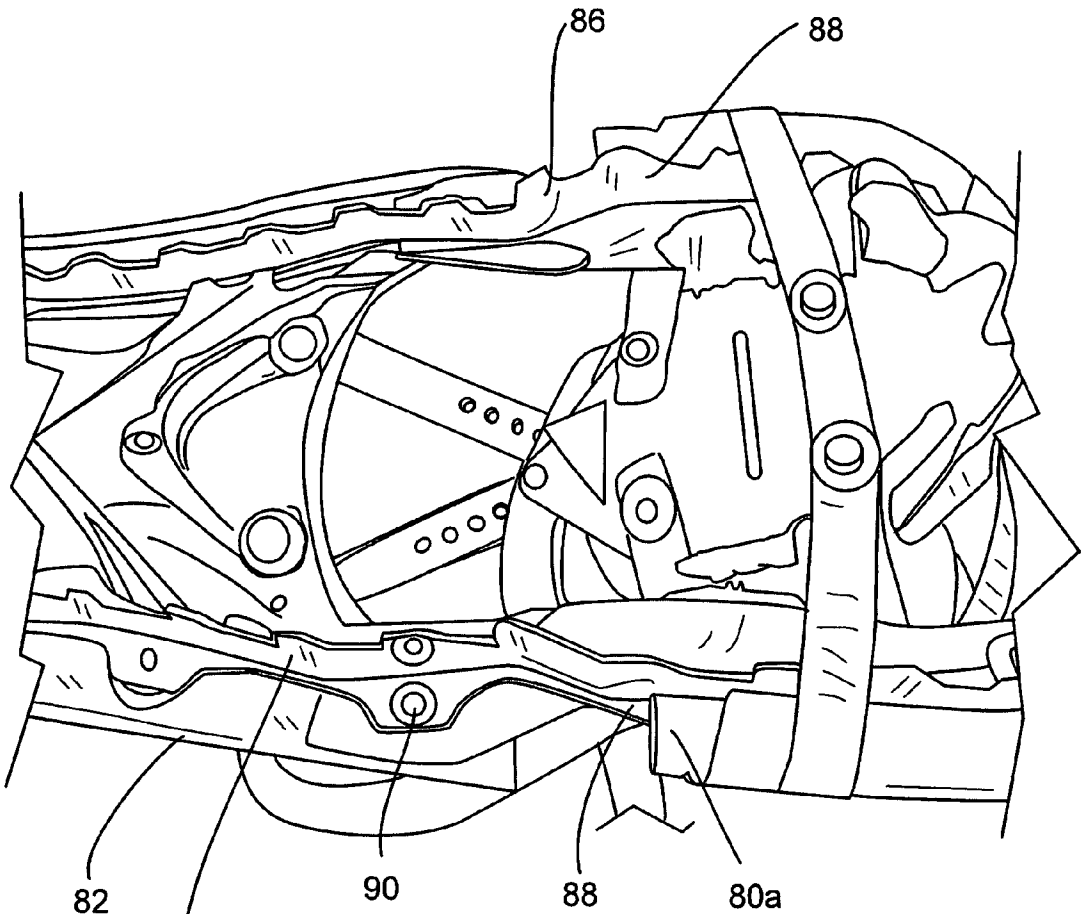
Figure 18:
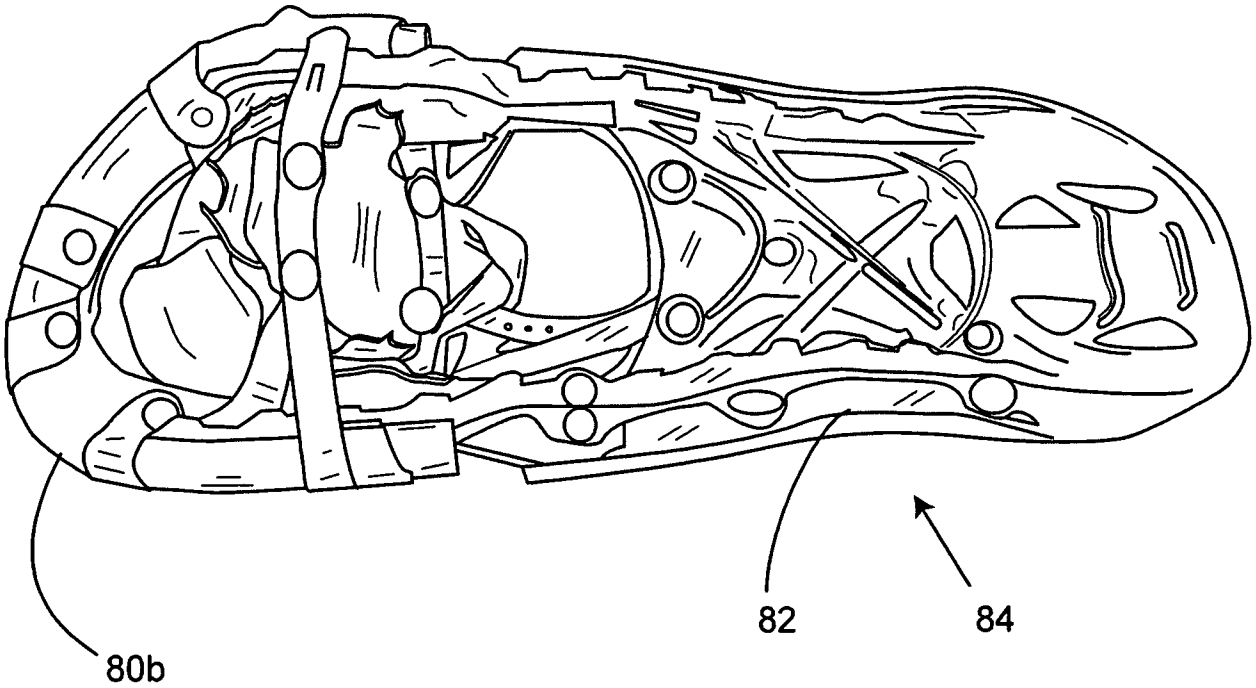

FIGS. 16, 17 and 18 show another embodiment of a snowshoe of the invention, in which a nose section 80 having the strength and resilience characteristics described above is secured to an aft plastic or composite section 82. FIGS. 16 and 17 show upper and lower portions of the snowshoe, respectively, while FIG. 18 shows a full snowshoe 84 in perspective bottom view.

Again, the nose section 80 has left and right arms 80*a* that suspend the snowshoe binding 86 with straps 42, in the same manner as in the above described embodiments. The nose section has characteristics and strength properties as described above. To the rear of the nose section, the plastic or composite aft section 82 is a molded component and is essentially rigid. Thus, if the arms 80*a* of the nose section 80 were to be rigidly connected to the aft section in a way that restricts or prevents inward movement of the arms under strap tensions, the binding suspension could not function as desired. The inability of the nose section to resiliently deform would make the suspension too stiff and unyielding.

Therefore, the relatively rigid aft section is connected to the nose section in a way that permits most of the nose section's resilience to be retained. This can be done in several different ways, but in the embodiment shown a pair of traction rails 86, each rigidly secured to the aft snowshoe section 82, have forward ends 88 that cantilever forward from the most forward rivet connection 90, about an inch to two inches to connections with the nose piece arms 80*a*. These rails 86 preferably are somewhat L-shaped in cross section and can be connected to the arms 80*a* by overlapping for several inches as shown, and bolted or riveted horizontally or vertically or both. A fairly extensive overlap can be made, e.g. about five or six inches, in order to provide traction elements in the region of the nose section, without entering into the up-tilted forward end 80*b* of the nose section.

Other forms of connection between nose and aft section can be used, and the nose piece can be secured to other types of aft sections.

The nose section described above could be of different material and somewhat different configuration. The nose can be a solid or laminate composite structure, such as a composite U-shaped resilient nose structure. This can be connected to distinctly different types of aft sections. The reference to a U-shaped nose defines a front end of the snowshoe and has arms extending aft for connection to the remainder of the snowshoe.

Reference to a snowshoe frame that includes an aft section is intended to include a solid or molded off section as the frame in that section.

The invention provides a snowshoe which is unique in being formed with very dissimilar cross sections, in the nose section and in the aft section, assembled together and with the snowshoe's binding suspended by the nose section. Previous suspended binding snowshoes have utilized the full length of a snowshoe frame, with integrally-extending left and right peripheral frame members, for the needed strength and resilience to support the suspended binding. In the invention the nose piece and aft section, each of which can have varying types of cross section, are separately formed and of dissimilar geometry and are assembled together by rivets, bolts or other fastening means.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A snowshoe with enhanced traction for snow and ice terrain, comprising:

a multi-component, assembled snowshoe frame including a nose section and an aft section, the aft section including a tail, the nose section being generally U-shaped, with an upturned forward end, the aft section being non-integral with and secured to aft ends of the nose section, the aft section including traction elements with teeth for engaging into terrain, extending downwardly from bottom portions of the aft section, and a boot binding positioned within a space defined by the frame, the boot binding being suspended on the frame by tension members comprising essentially inelastic straps extending transversely and connected to the binding and wound around aft portions of the nose section at left and right, the straps being in tension and pulling inwardly on the aft portions of the nose section, and positioned to establish a bias angle on the boot binding to tilt a user's boot heel-upward, and the straps and nose section providing a spring-loaded suspension so that when the binding bears the weight of a user and is rotated in pitch on the snowshoe frame, the nose section deflects resiliently, the aft portions being drawn inwardly, urging the binding toward the bias angle, and wherein the nose section has sufficient strength in itself to support tension from the tension members and to support the binding suspended within the snowshoe, for an adult user of the snowshoe, the nose section having sufficient strength to resiliently deform under at least thirty pounds of pulling tension from the tension members, without failure of the nose section.

2. The snowshoe of claim 1, wherein the aft section comprises two crampon rails, essentially vertical sections with crampon teeth.

3. The snowshoe of claim 1, wherein the nose section is of aluminum tubing.

4. The snowshoe of claim 1, wherein the nose section is of tubular metal and the aft section includes two crampon rails secured to aft ends of the tubular nose section, the aft ends of the nose section each having slits in a bottom side within which a forward end of a rail is inserted, and with fasteners securing the nose section and rails together.

5. The snowshoe of claim 1, wherein the nose section is primarily of tubular metal, and with aft ends of the nose section comprising crampon rails welded to the metal tubing, the aft section including two aft crampon rails that overlap with the aft ends of the nose section and are secured together by fasteners.

6. The snowshoe of claim 1, wherein the nose section is of metal tubing, and the aft section comprises a molded plastic deck connected to the aft ends of the nose section.

7. The snowshoe of claim 6, wherein the aft section of the snowshoe includes metal crampon rails secured to the plastic deck and oriented downwardly, the crampon rails extending forward from the aft section to connections with the aft ends of the nose section.

8. The snowshoe of claim 6, wherein the aft section is of fiber reinforced plastic.

9. The snowshoe of claim 1, wherein the nose section when pulled inwardly by the tension members exhibits a spring constant of at least about one hundred twenty pounds per inch.

10. The snowshoe of claim 1, wherein the nose section has sufficient strength to resiliently deform under at least about fifty pounds of pulling tension from the tension members, with resilience and without failure.

11. The snowshoe of claim 1, wherein the nose section has sufficient strength to resiliently deform under at least about sixty pounds of pulling tension from the tension members, with resilience and without failure.

12. A snowshoe of claim 1, wherein the nose section and the aft section of the frame are of dissimilar cross sections.

* * * * *